United States Patent [19]

Grosjean et al.

[11] 4,172,970

[45] Oct. 30, 1979

[54] ELECTRIC SWITCH

[75] Inventors: Laurent Grosjean, Neuchâtel; Daniel Rochat, Saint-Blaise, both of Switzerland

[73] Assignee: Ebauches S.A., Neuchâtel, Switzerland

[21] Appl. No.: 875,561

[22] Filed: Feb. 6, 1978

[30] Foreign Application Priority Data

Feb. 16, 1977 [CH] Switzerland ..... 1889/77

[51] Int. Cl.[2] ..... H01H 19/36

[52] U.S. Cl. ..... 200/11 R; 200/158

[58] Field of Search ..... 200/11 R, 11 D, 11 DA, 200/11 K, 158, 292; 339/17 R

[56] References Cited

U.S. PATENT DOCUMENTS

| | | | |
|---|---|---|---|
| 2,064,736 | 12/1936 | Dahl | 200/158 |
| 2,854,552 | 9/1958 | Gouverneur | 200/158 |
| 2,874,248 | 2/1959 | Tondat et al. | 200/158 X |
| 2,896,033 | 7/1959 | Hartz | 200/11 DA |
| 3,934,401 | 1/1976 | Wood | 200/11 R X |
| 4,004,119 | 1/1977 | Latour | 200/158 |

FOREIGN PATENT DOCUMENTS

| | | | |
|---|---|---|---|
| 1116404 | 6/1968 | United Kingdom | 200/158 |

OTHER PUBLICATIONS

J. M. Glasson et al., Western Electric, Technical Digest No. 20, "Programmable Through-Hole Connection", pp. 33, 34.

*Primary Examiner*—James R. Scott

*Attorney, Agent, or Firm*—Silverman, Cass & Singer, Ltd.

[57] ABSTRACT

An electric switch for connecting one or more of a plurality of leads on one side of an insulating substrate to a lead on the other side of the substrate. The switch includes a conductive contact member having a pin rotatably engaged in a hole in the substrate. The pin having a first end extending out of the first side of the substrate and having a head eccentrically connected thereto. The pin of the contact member is electrically connected to a lead on a second side of the substrate. Means are provided on the contact member for rotating the contact member head between the plurality of leads selectively to contact one or more of the leads on the first substrate side with the head to electrically connect the selected lead through the pin with the lead on the second substrate side.

7 Claims, 6 Drawing Figures

ELECTRIC SWITCH

BACKGROUND OF THE INVENTION

The present invention relates to an electric switch or commutation device.

SUMMARY OF THE INVENTION

This device is characterized by the fact that it comprises a substrate made of insulating material, provided, on one of its sides or faces, with at least two conductive tracks or leads, at least a contact member rotatably mounted on the substrate, and a conductor permanently connected to the contact member, the whole in such a way that, when placing this contact member into one or the other of two different angular positions, it is brought into contact with one or the other of the two conductive tracks, thus connecting one of the tracks with the conductor.

BRIEF DESCRIPTION OF THE DRAWING

The drawing shows, by way of example, several embodiments of the invention.

DESCRIPTION OF THE PREFERRED EMBODIMENT

Figure 1:
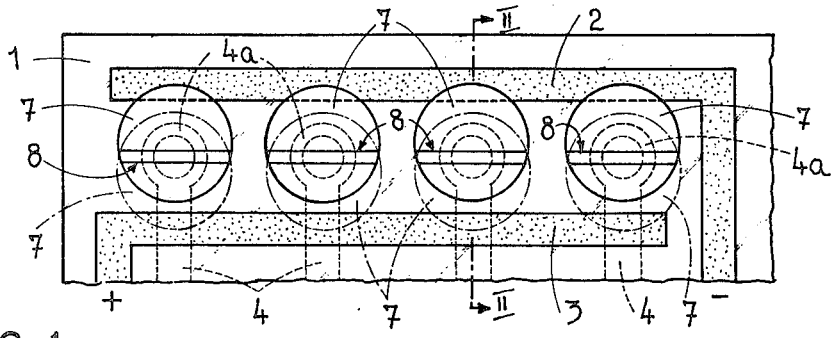
FIG. 1 is a plan view of a first embodiment of an electric switch or commutation device.
Figure 2:
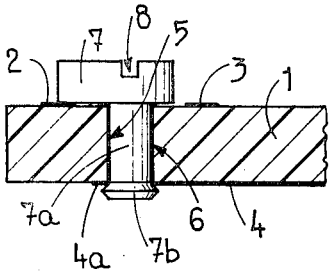
FIG. 2 is a sectional view along line II—II of FIG. 1.

The electric switch or commutation device represented in FIGS. 1 and 2 comprises a substrate 1, made of a plate of insulating material, one face of which is provided with two conductive metallized tracks or leads 2 and 3, rectilinear and parallel to each other.

The substrate 1 is provided, on its face or side opposed to that carrying the two tracks 2 and 3, with four conductive metallized tracks or leads 4, parallel to each other, reaching four holes 5 provided in the plate 1, between the conductive tracks 2 and 3, and only one of which is visible in the drawing (FIG. 2). Each track 4 is ended by a portion 4*a* having the shape of a ring, surrounding one of the holes 5. The wall of each hole 5 is metallized at 6, the metallized layer being in contact with the corresponding conductive ring 4*a*.

The device comprises four metallic contact members each of which comprises a circular head 7 provided with a pin 7*a*, eccentric with respect to the head 7, each of these pins being engaged in one of the holes 5. The pin 7*a* of each contact member is ended by a shoulder 7*b* maintaining in place the member 7 and creating some friction so that this member 7 cannot rotate freely. The head 7 of each contact member is provided with a slot 8 permitting it to be rotated by means of a screw-driver.

As is shown in FIG. 1, each contact member 7 can occupy two positions, one represented in solid lines and the other one in dotted lines, in one of which its head is in contact with the conductive track 2 and in the other of which it is in contact with the track 3, thus connecting one or the other of these conductive tracks with its conductive track 4.

Figure 3:
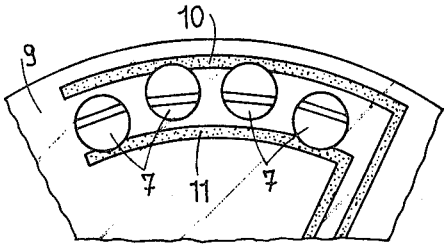
FIG. 3 is a plan view of a second embodiment of an electric switch or commutation device.

The embodiment of FIG. 3 differs from the first embodiment by the fact that the insulating substrate, designated by 9, is circular, the two conductive tracks 10 and 11 with which is provided on one of its faces, forming two concentric arcs of circle. The contact members 7 are rotatably mounted on the substrate 9, between the tracks 10 and 11.

Figure 4:
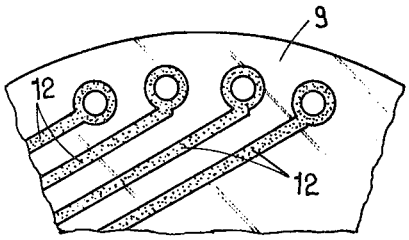
FIG. 4 is a plan view thereof, from underneath.

The conductive tracks, designated by 12, with which is provided the opposed face of the substrate extend parallel to each other as indicated in FIG. 4.

Figure 5:
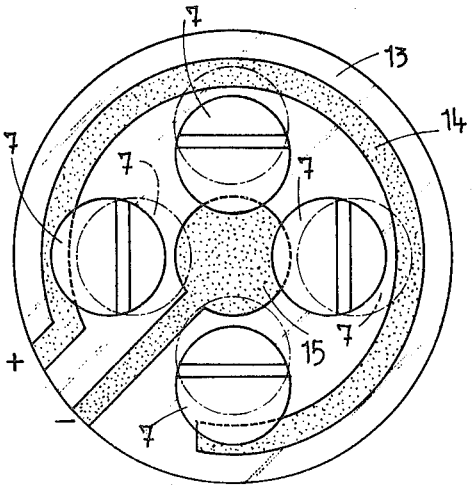
FIG. 5 is a plan view of a third embodiment of an electric switch or commutation device.
Figure 6:
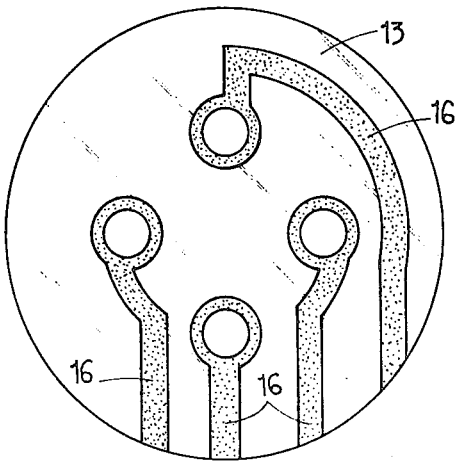
FIG. 6 is a plan view thereof, from underneath.

In the embodiment of FIGS. 5 and 6, the substrate is constituted by a circular washer 13, made of insulating material, one face of which is provided with a circular conductive track 14 and with a conductive track 15, having the shape of a pad, situated in the center of the track 14. The contact members 7 are arranged at 90° with respect to each other, between the conductive tracks 14 and 15.

The conductive tracks 16 provided on the opposite face of the substrate 13, which are visible in FIG. 6, are arranged in such a way as to reach the periphery of the substrate in points situated in the vicinity of each other.

The present electric switch or commutation device can be used for several purposes: It can, particularly, permit the frequency of an oscillator of an electronic watch to be adjusted by putting into the circuit capacitors of different values. In this case, its substrate will be constituted by the substrate of the printed circuit of the watch.

As a modification, one could provide a simplified embodiment of the device in which the latter will comprise only one contact member.

As a further modification, the head of the contact members could be other than circular, for instance, triangular, the pin being situated in the vicinity of one of the sides of the triangle, so that the opposite apex of the head comes into contact with one or the other of the conductive tracks, according to the angular position in which the contact member is placed.

One could also arrange the several elements of the device in such a way that the contact with one of the conductive tracks be interrupted before it has been established with the other one.

What is claimed is:

1. An improved electric switch including a substrate made of insulating material, said substrate having a first and a second side and being provided with at least one passage therethrough between said first and second side, a plurality of first conductive leads provided on said first side of said substrate, at least one second conductive lead provided on said second side of said substrate, said improvement comprising;

at least one conductive contact member having a pin rotatably engaged in said substrate passage, said pin having a first end extending out of said first side of said substrate with a head eccentrically connected thereto, said pin being electrically connected to said second conductive lead, and said contact member including means for rotating said contact member head between said plurality of first conductive leads to selectively contact said contact member head with at least one of said first conductive leads, electrically connecting said selected first conductive lead with said second conductive lead through said contact member head and pin.

2. An improved electric switch as claimed in claim 1 in which said head of said contact member includes a substantially circular shape normal to the pin axis.

3. An improved electric switch as claimed in claim 1 in which the surface of said substrate formed by said passage in said substrate is metallized and said metallized surface is connected to said second conductive lead to produce an electrical contact between said contact member pin and said second conductive lead.

4. An improved electric switch as claimed in claim 1, in which there are a plurality of said contact members each engaged in a separate substrate passage, and a plurality of second conductive leads, with each of said contact members being connected to a different one of said second conductive leads.

5. An improved switch as claimed in claim 4 in which at least a pair of said first conductive leads are rectilinear and spaced parallel from each other, at least one passage and its contact member being located between said pair of first conductive leads.

6. An improved switch as claimed in claim 4 in which at least a pair of said first conductive leads are arranged in concentric arcs of a circle spaced from each other, at least one passage and its contact member being located between said pair of first conductive leads.

7. An improved switch as claimed in claim 4 in which one of said first conductive leads has a semi-circle shape, another of said first conductive leads having an enlarged end pad, said pad arranged in the center of and spaced from said semi-circle, at least one passage and its contact member being located between said pad and said semi-circle of said first conductive leads.

* * * * *